United States Patent [19]

Pallotta

[11] 4,373,448

[45] Feb. 15, 1983

[54] SHELF ASSEMBLY AND BRACKET THEREFOR

[75] Inventor: Frank Pallotta, Mississauga, Canada

[73] Assignee: DSH, Concord, Canada

[21] Appl. No.: 236,328

[22] Filed: Feb. 20, 1981

[51] Int. Cl.[3] ..... A47B 41/04

[52] U.S. Cl. ..... 108/29; 211/123

[58] Field of Search ..... 108/29, 28, 101, 111; 211/123, 134, 153; 248/250, 247, 248, 235

[56] References Cited

U.S. PATENT DOCUMENTS

| | | | |
|---|---|---|---|
| 2,946,600 | 6/1960 | La Bonia et al. | 108/28 |
| 3,102,499 | 9/1963 | Shelor | 108/28 |
| 3,120,309 | 2/1964 | Goettl et al. | 211/123 |
| 3,221,676 | 12/1965 | Sedo | 211/90 |
| 3,339,749 | 9/1967 | Odegaard et al. | 211/94 |
| 3,437,214 | 4/1969 | Sainsbury | 248/247 X |
| 3,688,915 | 9/1972 | Ramsey | 211/123 |
| 3,865,336 | 2/1975 | Robertson | 108/29 X |
| 3,870,157 | 3/1975 | Hayward | 108/29 X |
| 4,184,660 | 1/1980 | Anderson | 108/29 X |

FOREIGN PATENT DOCUMENTS

| | | | |
|---|---|---|---|
| 1081195 | 7/1980 | Canada | 108/29 |

*Primary Examiner*—William E. Lyddane

*Attorney, Agent, or Firm*—Ridout & Maybee

[57] ABSTRACT

A combined shelf and hanger bar system which is easy to install and has a neat appearance makes use of end brackets having wall plates for securement to closet end walls, inwardly projecting walls defining ledges to support the ends of a shelf panel, and pockets to receive and hide the ends of front and rear rails stiffening the longitudinal edges of the panel, the front rail also having a depending portion providing a hanger bar.

6 Claims, 2 Drawing Figures

SHELF ASSEMBLY AND BRACKET THEREFOR

FIELD OF THE INVENTION

Figure 1:
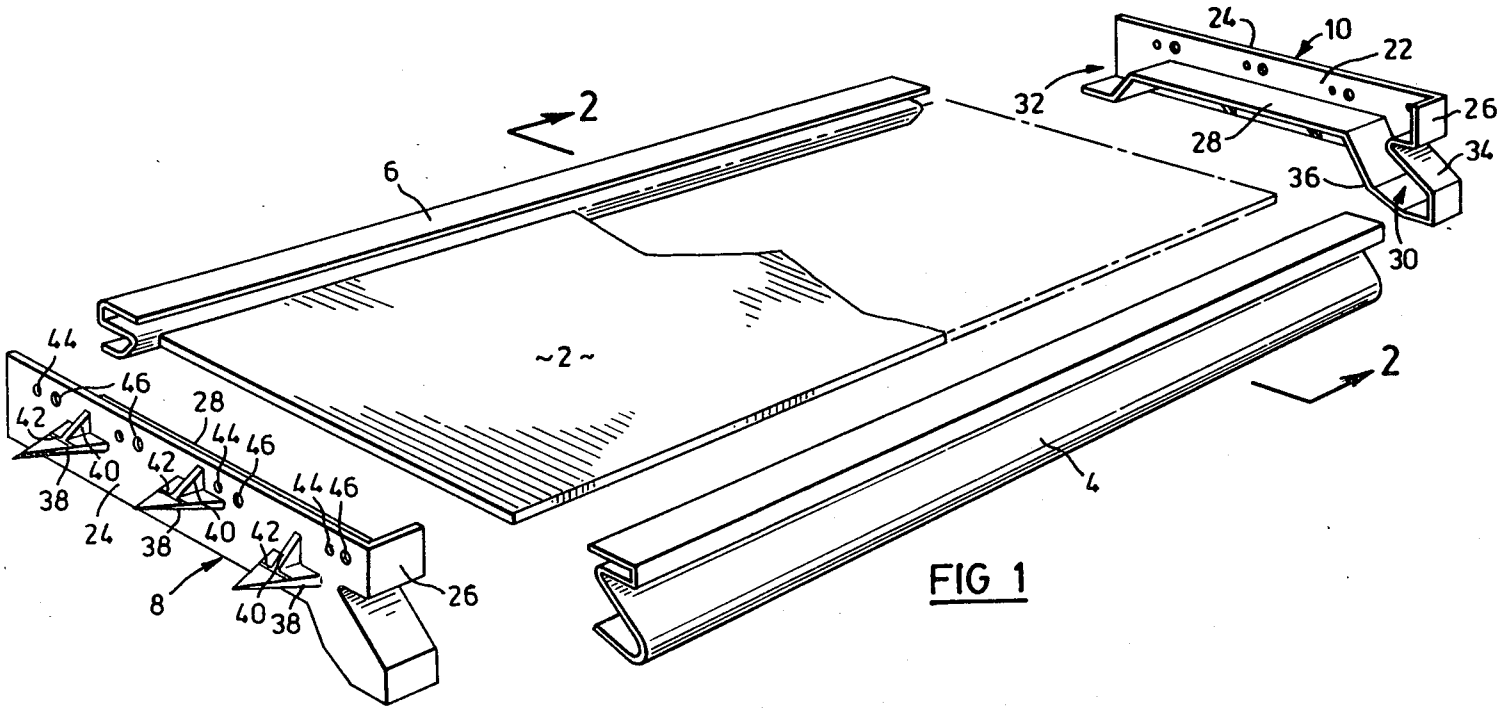

This invention relates to shelves for closets and the like.

BACKGROUND OF THE INVENTION AND PRIOR ART STATEMENT

In hanging closets, it is common practice to provide a hanging bar for clothes, and a shelf above the hanging bar for storage of lightweight items. Various proposals have been made for combination shelf edges and hanger supports, which provide the function of the hanger bar whilst finishing and supporting the front edge of the shelf. The latter may be of relatively flimsy material such as hardboard, which requires support at all four edges. Support at the rear and end edges is commonly provided by nailing strips which must be cut to size, and some means may be provided to finish the ends of the shelf edge and hanger support. Examples of prior art arrangements are to be found in U.S. Pat. Nos. 3,120,309 (Goettle et al), 3,339,749 (Odegaard et al) and 3,688,915 (Ramsey), the last of these being considered most nearly typical of the present state of the art.

Proposals have been made for more fully prefabricated combination shelves and hanger bars, the shelves being all metal and of telescopic constructions to accommodate variations in width. Such shelves do away with the requirement for separate nailing strips but are necessarily somewhat costly and are also bulky to ship. Examples of such proposals are to be found in U.S. Pat. No. 2,946,600 (La Bonia et al) and U.S. Pat. No. 3,221,676 (Sedo). Proposals have also been made in Canada for moulded plastic end brackets to support a rigid shelf and separate hanger bar.

SUMMARY OF THE INVENTION

The present invention relates to shelf systems and more particularly to a shelf bracket, intended for applications of the type discussed above, which is cheap to manufacture, easy to install, and provides a neat finish.

According to the invention, there is provided a combined shelf and hanger bar system for a closet comprising a planar shelf panel, a rear shelf rail the same length as the panel and engageable therewith to receive and support the rear edge of the panel, a front shelf rail the same length as the panel and engageable therewith to receive and support the front edge of the panel, the front rail having a section including a downwardly depending portion shaped to support garment hangers, and a pair of unitary moulded end brackets each having a wall plate having a wall engaging surface and means to enable its attachment to a wall, and a wall extending perpendicularly from its opposite surface and having a horizontal centre portion forming a ledge engageable with the underside of one end of the shelf panel and end portions defining deep front and shallow rear pockets extending downwardly relative to the ledge and engageable with at least front and bottom surfaces of the ends of the front and rear rails respectively. Preferably the front pocket and the depending portion of the front rail have front walls which are angled generally forwardly from top to bottom. In one embodiment, the means to enable attachment of each end bracket to a wall include integral dry-wall penetrating blades extending from the wall engaging surface. The invention also extends to the wall brackets per se.

The invention enables very simple and neat installation of closet shelves and hanger bars. The end brackets are attached to opposing walls, the shelf panel and rails are cut to length and the rails are assembled to the front and rear edges of the panel. The assembly is engaged with the brackets so that the panel ends rest on the ledges and the rail ends enter the pockets. If the front pocket has its walls forwardly angled as preferred, the depending portion of the front rail may be flexed rearwardly to allow its insertion into the pocket and then springs forward to hold the shelf in place. The walls on the brackets hide the front and lower surfaces of the ends of the panel and rails and provide a neat finish without the use of separate trim components, whilst all four edges of the panel are supported. The front rail may be of conventional section, such as that disclosed in U.S. Pat. No. 3,688,915, whilst the rear rail may be similar to that used for providing the rails or stiles of closet door panels, or of any section which can be applied to the rear edge of the panel to provide the necessary stiffening. Thus implementation of the invention does not require use of any special rail sections that are not already available. The rails are held onto the panel by virtue of their engagement with the bracket pockets, and no additional securing means is required.

Figure 2:
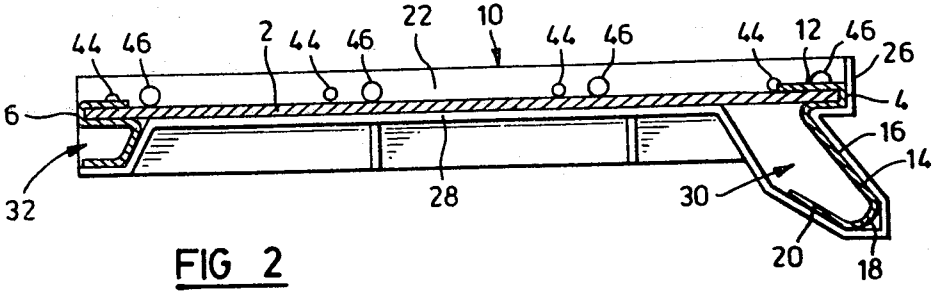

The invention is described further in the accompanying drawings in which :

FIG. 1 is a perspective exploded view of a shelf and hanger bar assembly in accordance with the invention; and FIG. 2 is a lateral section through the assembly.

Referring to the drawings, a shelf and hanger bar assembly for a closet comprises five components, a shelf panel 2, which may be a relatively thin hardboard panel, usually with a decorative finish, front and rear rails 4 and 6, and left and right end brackets 8 and 10.

Typically the front rail is of a section commonly used in such applications, and is somewhat similar to that shown in U.S. Pat. No. 3,688,915. The rail section has an upper portion 12 defining a rearwardly facing channel which presses on to the front edge of panel 2, and a lower portion 14, having a front wall 16 defining a fascia and bottom and rear walls 18 and 20 defining a rearwardly and upwardly facing channel adapted to receive the hooks of garment hangers. Both the front and rear walls 16 and 20 are inclined generally forwardly. It should be understood that the rail section is susceptible to variation provided that it provides the desired function of reinforcing the panel edge and providing a depending portion shaped to support garment hangers. For example, even a rail such as that shown in U.S. Pat. No. 3,339,749 could be utilized, in which the depending portion of the rail section has a downward opening re-entrant section to retain runners for supporting garment hangers.

The rear rail 6 must also be configured to fit onto and reinforce the rear edge of the panel, and several suitable rail sections are readily available, such as that shown which is a section used to reinforce the edge of sliding door panels.

The end brackets 8 and 10 are the only parts required which are unique to the present invention. Each one is a mirror image of the other so as to suit them for use at opposite ends of the shelf. Each has a wall plate 22 having a wall engaging surface 24. A wall 26 projects perpendicularly from its opposite surface and forms a ledge 28, supporting an end of the panel 2, and pockets 30 and 32 extending downwardly at each end of the ledge and configured to accommodate the ends of the front and rear rails 4 and 6 respectively. In the example shown, the portions of the wall forming the front and rear walls 34 and 36 of the deeper front pocket 30 are inclined generally forwardly from top to bottom similarly to the walls 16 and 20 of the rail 4. This means that when the panel 2 and rails 4 and 6 are cut to length just less than the spacing between the wall plates 22 when installed and the rails are assembled to the panel, the assembly can be placed with the rear rail in the pocket 32 and the depending portion 14 of the front rail bent back so that it may be sprung into the pocket 30. It will be understood that the rear ends of the brackets 8 and 10 will normally be installed against the rear wall of a closet, and thus the pockets 32 require no back walls, but such back walls could be provided if required.

In order to enable securement of the brackets 8 and 10 to the side walls of a closet, various provisions may be made. The nature of the installation with the shelf supported at both ends means that the loads to be supported will be essentially vertical and the function of any fastening devices used will be mainly to transfer this loading to the walls rather than resisting withdrawal. Where the walls are of drywall or similar material, blades 38 moulded integrally with the brackets may be utilized to penetrate the drywall and transfer loadings through their lower surfaces. These blades are reinforced by ribs 40 and may be provided with lines at weakness 42 to enable the ends of the blades to be broken off where penetration is limited by studs or other structural members. Where the blades can be used, the brackets may simply be hammered into engagement with the wall.

The blades 38 may be either supplemented or replaced completely by sets of fixing holes 44 and 46. The holes 44 may be used where the closet wall is wood or on a wire lath backing which will provide a secure anchorage for screws or nails. The larger holes 46 provide for the use of suitable forms of load spreading anchor when the wall structure is such that ordinary screws or nails cannot transfer sufficient load; they also provide alternative locations for screws or nails in the event that some of the holes 44 cannot be used because of structural obstructions.

When the shelf is installed, the wall 26 hides the ends of the rails 4 and 6 and the panel 2 from below and in front, thus providing a neat appearance, whilst at the same time the nails are locked to the panel, which is supported at all four edges without the need for any rear nailing strip. The rails and shelf can all be cut to the same length, and no special preparation of the cut ends is required since these are hidden by the brackets. The only fasteners required for installation are those used to secure the brackets to the end walls, and even these may be integral with the brackets if the blades 38 are present.

What I claim is:

1. A combined shelf and hanger bar system for a closet comprising a planar shelf panel, a rear shelf rail the same length as the panel and engageable therewith to receive and support the rear edge of the panel, the rear shelf rail having a cross section having an upper portion receiving the rear edge of the panel and a reinforcing depending portion, a front shelf rail the same length as the panel and engageable therewith to receive and support the front edge of the panel, the front rail having a section including an upper portion engaging a front edge of the panel and a depending portion having an upturned flange for supporting garment hangers, and a pair of unitary moulded end brackets each having a wall plate having a wall engaging surface extending perpendicular to the shelf and to the rails and means to enable its attachment to a wall, and a flange extending perpendicularly from its opposite surface and having a horizontal centre portion forming an upwardly open ledge, engageable with the underside of one end of the shelf panel, and end portions defining a deep front upwardly open pocket and a shallow rear upwardly open pocket each extending downwardly relative to the ledge and engageable with the ends of the depending portions of the front and rear rails respectively.

2. A combined shelf and hanger bar system according to claim 1, wherein the portion of the flange forming the front wall of the front pocket and the front wall of the depending portion of the front rail are angled generally forwardly from top to bottom.

3. A combined shelf and hanger bar system according to claim 1 or 2, wherein the end brackets incorporate integral drywall-penetrating blades projecting in horizontal planes from their wall engaging surfaces.

4. An end bracket for a shelf and hanger bar system comprising a vertical wall plate having a surface for engaging a wall extending perpendicular to the shelf and a flange extending perpendicularly from the other surface of the wall plate, the flange defining an upwardly open horizontal ledge extending parallel to the wall plate and engageable with the underside of one end of a shelf panel, and a deep front upwardly open pocket adjacent a front end of the wall plate and a shallow rear upwardly open pocket adjacent a rear end of the wall plate, each pocket extending downwardly from the ledge and being engageable with the ends of depending portions of a front combined rail and hanger bar and of a rear rail applied respectively to the front and rear edges of the shelf panel.

5. An end bracket according to claim 4, wherein at least the portion of the flange forming a front wall of the front pocket is angled generally forwardly front top to bottom.

6. An end bracket according to claim 4 or 5, incorporating integral dry-wall penetrating blades projecting in horizontal planes from its wall engaging surfaces.

* * * * *